US009607738B1

(12) United States Patent
Wu et al.

(10) Patent No.: US 9,607,738 B1
(45) Date of Patent: Mar. 28, 2017

(54) CABLE HAVING IMPROVED WIRES ARRANGEMENT

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/298,129

(22) Filed: Oct. 19, 2016

(30) Foreign Application Priority Data

Oct. 19, 2015 (CN) ..... 2015 1 0675391

(51) Int. Cl.

| | |
|---|---|
| ***H01B 11/00*** | (2006.01) |
| ***H01B 11/20*** | (2006.01) |
| ***H01B 11/02*** | (2006.01) |
| ***H01R 13/658*** | (2011.01) |
| *H01B 9/00* | (2006.01) |

(52) U.S. Cl.
CPC ..... *H01B 11/20* (2013.01); *H01B 11/02* (2013.01); *H01R 13/658* (2013.01); *H01B 9/003* (2013.01); *H01B 9/006* (2013.01)

(58) Field of Classification Search
CPC ... H01B 7/00; H01B 7/02; H01B 7/03; H01B 9/003; H01B 9/006; H01B 9/02; H01B 11/02; H01B 11/06
USPC ..... 174/102 R, 108, 106 R, 110 R, 113 R, 174/113 C
See application file for complete search history.

(56) References Cited

U.S. PATENT DOCUMENTS

| | | | | |
|---|---|---|---|---|
| 6,674,010 | B2 * | 1/2004 | Inui | H01B 11/06 174/113 C |
| 7,304,241 | B2 * | 12/2007 | Trieb | H01R 9/032 174/74 R |
| 7,918,685 | B1 * | 4/2011 | Kruckenberg | H01B 11/00 174/75 C |
| 8,546,690 | B2 * | 10/2013 | Masakazu | H01B 11/002 174/103 |

(Continued)

OTHER PUBLICATIONS

Universal Serial Bus Type-C Cable and Connector Specification Revision 1.0 Aug. 11, 2014.

*Primary Examiner* — William H Mayo, III
(74) *Attorney, Agent, or Firm* — Wei Te Chung; Ming Chieh Chang

(57) ABSTRACT

A USB Type-C cable includes: a number of first wires and second wires, the first wires including a power wire for transmitting a power signal and plural coaxial wires for transmitting high speed signal, the second wires including at least one detective wire for transmitting detective signal, at least one power return wire for grounding, at least one twisted pair of wires for transmitting USB 2.0 signal, and at least one subsidiary wire for transmitting subsidiary signal; a jacket made of insulative material and receiving the first wires and the second wires; and a metal shield layer coating around the twisted pair of wires; wherein the first wires are arranged along an inner wall of the jacket in a circle and forms a cavity without a metal shield layer to receive the second wires, and the detective wire and the subsidiary wire are separated by the power return wire.

20 Claims, 4 Drawing Sheets

(56) References Cited

U.S. PATENT DOCUMENTS

| | | | | |
|---|---|---|---|---|
| 9,244,240 | B2 * | 1/2016 | Hayashishita | G02B 6/4434 |
| 9,508,467 | B2 * | 11/2016 | Pon | H01B 9/003 |
| 2003/0121694 | A1 * | 7/2003 | Grogl | H01B 3/441<br>174/113 R |
| 2005/0061536 | A1 * | 3/2005 | Proulx | G06Q 10/08<br>174/102 R |
| 2010/0051318 | A1 * | 3/2010 | Wang | H01B 11/12<br>174/113 R |
| 2010/0084157 | A1 * | 4/2010 | Wang | H01B 11/12<br>174/107 |
| 2010/0258333 | A1 * | 10/2010 | Horan | H01B 11/1091<br>174/78 |
| 2011/0278043 | A1 * | 11/2011 | Ueda | H01B 7/1895<br>174/115 |
| 2012/0103651 | A1 | 5/2012 | Kim | |
| 2016/0079689 | A1 | 3/2016 | Wu et al. | |
| 2016/0079714 | A1 | 3/2016 | Wu et al. | |

* cited by examiner

CABLE HAVING IMPROVED WIRES ARRANGEMENT

BACKGROUND OF THE INVENTION

1. Field of the Invention

The present invention relates to a cable, and more particularly to a Universal Serial Bus (USB) Type-C cable.

2. Description of Related Arts

USB Type-C Cable and Connector Specification Revision 1.0, published on Aug. 11, 2014, illustrates a high speed cable comprising a plurality of first wires (for USB 2.0 signaling, SBU1, SBU2, CC, power return, and Vconn), an inner shielding layer enclosing the first wires, a plurality of coaxial wires (differential pairs) for high speed signaling arranged at an outer side of the inner shielding, and a power wire disposed between the coaxial wires.

U.S. Patent Application Publication No. 2016/0079714, published to Wu et al. on Mar. 17, 2016, discloses a cable comprising a plurality of coaxial wires having a similar structure as the high speed cable of the USB Type-C Cable Specification Revision 1.0. Low frequency cross talk between the first wires for SBU1, SBU2 and first wire for CC, and between the first wires for SBU1, SBU2 and the first wire for USB 2.0 need be reduced.

An improved USB Type-C cable is desired to offer advantages over the related art.

SUMMARY OF THE INVENTION

An object of the present invention is to provide a cable having improved wires arrangement.

To achieve the above-mentioned object, a Universal Serial Bus (USB) Type-C cable includes: a plurality of wires including a plurality of first wires and a plurality of second wires, the plurality of first wires including a power wire for transmitting a power signal and a plurality of coaxial wires for transmitting high speed signal, the plurality of second wires including at least one detective wire for transmitting detective signal, at least one power return wire for grounding, at least one twisted pair of wires for transmitting USB 2.0 signal, and at least one subsidiary wire for transmitting subsidiary signal; a hollow jacket made of insulative material and receiving the plurality of first wires and the plurality of second wires; and a metal shield layer coating around the twisted pair of wires; wherein the plurality of first wires are arranged along an inner wall of the hollow jacket in a circle and forms a cavity without a metal shield layer to receive the plurality of second wires, and the detective wire and the subsidiary wire are separated by the power return wire.

and

Figure 1:
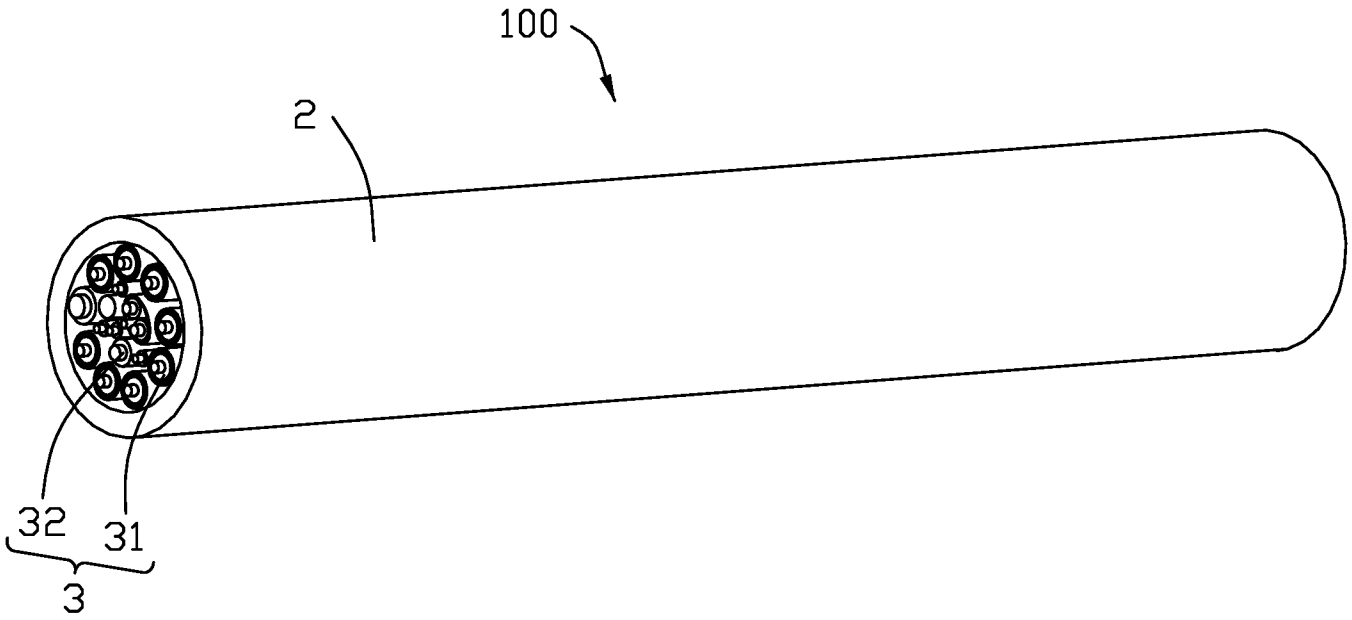
FIG. 1 is a perspective view of a cable according to the present invention.
Figure 3:
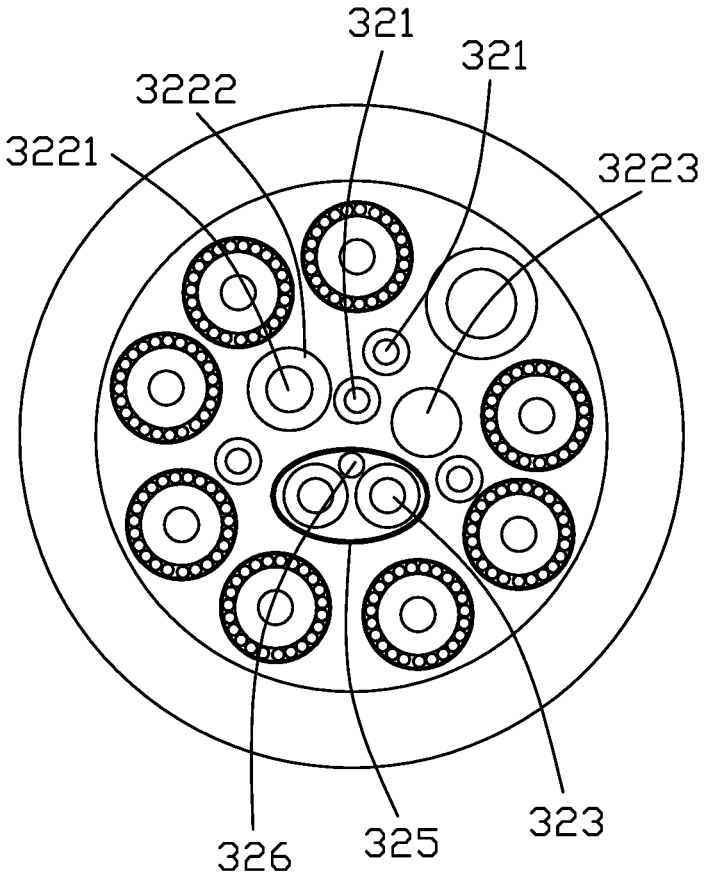

FIG. 3 is an opposite side cross section view of the cable as shown in FIG. 1.

Figure 4:
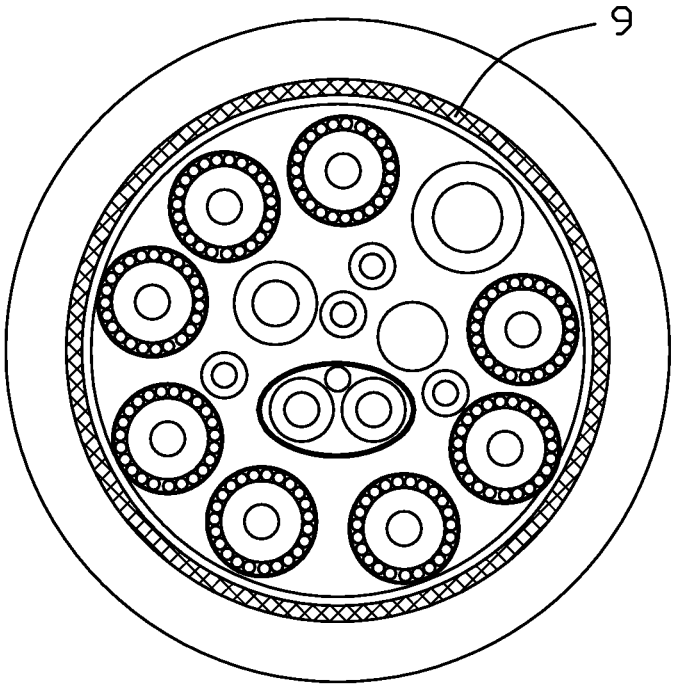

FIG. 4 is a cross section view of the cable according to another embodiment of the invention.

DETAILED DESCRIPTION OF THE PREFERRED EMBODIMENT

Figure 2:
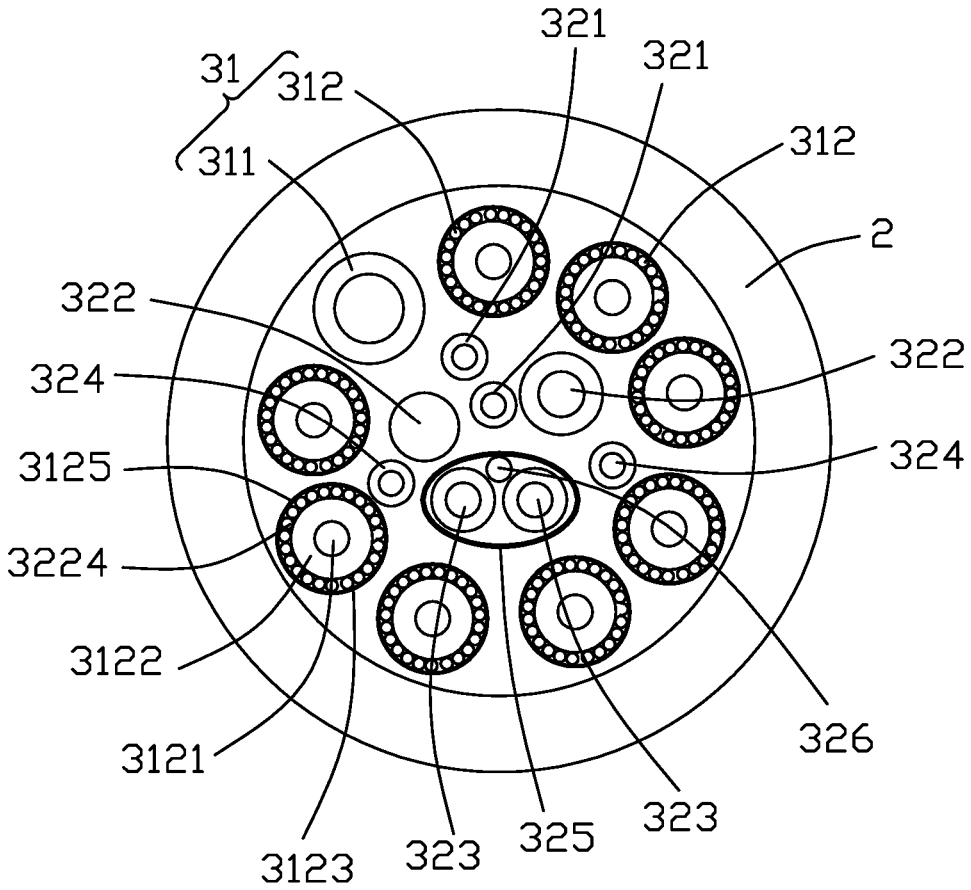
FIG. 2 is a cross section view of the cable as shown in FIG. 1.

Reference will now be made in detail to a preferred embodiment of the present invention. Referring to FIGS. 1 to 3, a USB Type-C cable 100 according to the present invention is shown. The USB Type-C cable 100 comprises a hollow jacket 2, and a plurality of wires 3 received in the jacket 2. The jacket 2 made of insulating material and having a tubular shape.

The wires 3 comprises a plurality of first wires 31 and second wires 32 which may be deemed as located in the outer ring zone (not labeled) and the inner center zone (not labeled) in the hollow jacket 2, respectively. The first wires 31 arranged along an inner wall of the jacket 2 in a circle and then these first wires 31 forming a cavity to receive the second wires 32. The diameter of the first wires 31 is greater than the second wires 32. In accord with cantilever beam theory, when bending the USB Type-C cable 100, the stress was concentrated on a surface of the USB Type-C cable 100. More specifically, one surface of the USB Type-C cable 100 is pressurized and opposite surface is tensile. In other words, the smaller the cable is, the less pressure the cable will be bear. The second wires 32 defining a small size and disposed at a central portion of the jacket 2, the first wires 31 defining a big size and disposed around the inner surface of the jacket 2. Thus, the USB Type-C cable 100 has high strength and flexural capacity.

The first wires 31 comprise a power wire 311 for transmitting a power signal and a plurality of coaxial wires 312 for transmitting high speed signal. The coaxial wires 312 comprise four pairs of differential signals. Each of the coaxial wire 312 comprises a third inner conductor 3121, an inner insulative layer 3122 coating around the third inner conductor 3121, an metal layer 3123 coating around the inner insulative layer 3122, a metal braid layer 3124 coating around the metal layer 3123, and a outer insulative layer 3125 coating around the metal braid layer 3124.

The second wires 32 includes two detective wires 321, two power return wires 322 for grounding, two twisted pair wires 323 for transmitting USB 2.0 signal, and two subsidiary wires 324 for transmitting the subsidiary signal. The two power return wires 322 setting distant to each other, one of the power return wire 322 includes a first/unexposed inner conductor 3221 and a first insulative layer 3222 coating around the first inner conductor 3221, the other power return wire 322 includes only one second/bare(exposed) inner conductor 3223. As existing techniques, the USB Type-C cable 100 used for connecting with a connector (not shown), said connector (not shown) includes a printed circuit board (not shown) and a metal shell (not shown) for receiving the printed circuit board (not shown). The first inner conductor 3221 is electrically connected to the printed circuit board (not shown), the second inner conductor 3223 is connected to the metal shell (not shown). One of the power return wire 322 is a bare wire and other is a conductor coating around an insulative layer. This project overcomes existing processing complexity of soldering two power return wire together to the printed circuit board (not shown). In this embodiment, the first inner conductor 3221 is regarded as an inner grounding piece while the second inner conductor 3223 is regarded as an outer grounding piece.

The USB Type-C cable 100 further includes a metal shield layer 325 coating around the two twisted pair wires 323 and a bare grounding wire 326, the two twisted pair wires 323 is electrically connected to the metal shield layer 325. The metal shield layer 325 can be made of aluminum material, the bare grounding wire 326 defines a flanging connected to the metal shield layer 325. That can reduce the crosstalk between the two twisted pair wires 323 and the two detective wires 321, the two twisted pair wires 323 and the two subsidiary wires 324.

The twisted pair wires 323 located opposite to one of the detective wire 321 in a radial direction. Said detective wire 321 is located between the two power return wires 322. The two subsidiary wires 324 are located at opposite sides of the metal shield layer 325 respectively. Each power return wire 322 is located between one subsidiary wire 324 and one detective wire 321 for separating the subsidiary wire 324 and the detective wire 321 to reduce the crosstalk between subsidiary wire 324 and the detective wire 321. Further, the two detective wires 321 are all set between the two power return wires 322, one of the detective wires 321 as an detective wire and the other as a power wire for driving a chip (not shown) of the USB Type-C cable 100. Of course, when the USB Type-C cable 100 has no chip in it, the detective wire 321 could be only one. The power wire 311, the detective wire 321, the subsidiary wire 324 and the twisted pair wire 323 are all single core wire, and all include a middle conductor and a insulative layer coating around said middle conductor. The conductor is made of copper.

Besides that, the present invention removes the aluminum foil layer between the first wires 31 and the second wires 32 which is shown in the standard specification cited in the submitted IDS (Information Disclosure Statement). Thus, said first wires 31 and the second wires 32 can directly contact to each other for reducing the volume of the USB Type-C cable 100, and also can let the cable become more flexible for operation. Differently, in another embodiment as shown in FIG. 4, an optional tubular/ring like metallic braiding layer 9 is intimately located upon an interior surface of the jacket 2 and surrounding said wires 3. In such an embodiment, the power return wire 322 having the second inner conductor 3223, directly mechanically and electrically connects to the braiding layer 9 around the end of the cable 100. Similarly, the metal layer 3123 of each coaxial wire 312 is also mechanically and electrically connected to the braiding layer 9 around the same end of the cable 100. Furthermore, the shield layer 325 is also mechanically and electrically connected to the braiding layer 9 around the same end of the cable 100. Optionally, as mentioned before, the insulative layer 3222 may be coated with a conductive layer which also may mechanically and electrically connect to the braiding layer 9 at the same end of the cable 100. Understandably, the braiding layer 9 may be connected to the aforementioned metal shell (not shown) of the connector (not shown). Understandably, the connector including the metal shell and the interior printed circuit board may be referred to U.S. Application Publication No. 2016/0079714 having the same applicant with the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Universal Serial Bus (USB) Type-C cable comprising:

a plurality of wires including a plurality of first wires and a plurality of second wires, the plurality of first wires including a power wire for transmitting a power signal and a plurality of coaxial wires for transmitting high speed signal, the plurality of second wires including at least one detective wire for transmitting detective signal, at least one power return wire for grounding, at least one twisted pair of wires for transmitting USB 2.0 signal, and at least one subsidiary wire for transmitting subsidiary signal;

a hollow jacket made of insulative material and receiving the plurality of first wires and the plurality of second wires; and a metal shield layer coating around the twisted pair of wires;

wherein the first wires are arranged along an inner wall of the hollow jacket in a circle and forms a cavity without a metal shielding layer to receive the plurality of second wires, and the detective wire and the subsidiary wire are separated by the power return wire.

2. The USB Type-C cable as recited in claim 1, wherein the metal shield layer is made of aluminum material.

3. The USB Type-C cable as recited in claim 1, wherein the plurality of second wires comprise a bare grounding wire received in the metal shield layer and electrically connected to the metal shield layer.

4. The USB Type-C cable as recited in claim 3, wherein the at least one power return wire comprises a pair of power return wires separated from each other, one of the power return wires including a first inner conductor and a first insulative layer coating around the first inner conductor, the other power return wire including only one second inner conductor.

5. The USB Type-C cable as recited in claim 4, wherein the detective wire is located between the two power return wires, and the at least one subsidiary wire includes a pair of subsidiary wires located at opposite sides of the metal shield layer, respectively.

6. The USB Type-C cable as recited in claim 4, wherein the first inner conductor is electrically connected to an external printed circuit board of a connector, and the second inner conductor is connected to an external metal shell of the connector.

7. The USB Type-C cable as recited in claim 6, wherein the bare grounding wire is electrically connected to the external metal shell.

8. The USB Type-C cable as recited in claim 1, wherein a diameter of the first wire is greater than a diameter of the second wire.

9. The USB Type-C cable as recited in claim 1, wherein the plurality of coaxial wires include four pairs of differential signal wires, and the at least one detective wire includes a pair of detective wires.

10. The USB Type-C cable as recited in claim 1, wherein the plurality of first wires are directly contact with the plurality of second wires.

11. A USB (Universal Serial Bus) Type-C cable assembly comprising:

an insulative jacket defining an interior space essentially composed of an outer ring zone and an inner center zone;

a plurality of first wires located in the outer ring zone and including eight differential-pair wires and one power wires being disposed wherein each of said differential-pair wires is a coaxial wire having an inner conductor concentrically enclosed by an metallic layer;

a plurality of second wires located in the inner center zone and including two twisted-pair wires associated with a grounding wire commonly enclosed within a metallic shielding layer for USB 2.0 transmission, two subsidiary wires and at least one detective wire being arranged in a triangular configuration beside said metallic shielding layer; wherein no additional ring type metallic shielding layer is disposed between the first wires and the second wires.

12. The USB Type-C cable assembly as claimed in claim 11, wherein a diameter of each of said second wire is smaller than that of each of the first wires.

13. The USB Type-C cable assembly as claimed in claim 11, wherein said second wires further including two power return wires, wherein each of said two power return wires is located beside the metallic shielding layer and between the at least one detective wire and the corresponding subsidiary wire, one of said two power return wires including only exposed inner conductor while the other of said two power return wires including an unexposed inner conductor enclosed within the insulative layer.

14. The USB Type-C cable assembly as claimed in claim 13, further including a metallic braiding layer intimately inside said insulative jacket to surround the first wires, wherein said exposed inner conductor is electrically connected to said braiding layer.

15. The USB Type-C cable assembly as claimed in claim 14, further including a connector having a metallic shell enclosing a printed circuit board therein, wherein said unexposed inner conductor is soldered upon the printed circuit board while said exposed inner conductor is electrically connected to the metallic shell.

16. The USB Type-C cable assembly as claimed in claim 14, wherein the metallic shielding layer of the twisted pair wires for USB 2.0 transmission, and the metallic layer of each of the coaxial wires both are mechanically and electrically connected to the metallic braiding layer.

17. A USB (Universal Serial Bus) Type-C cable assembly comprising:

an insulative jacket defining an inner space essentially composed of an outer ring zone and an inner center zone;

a tubular metallic braiding layer intimately disposed upon an interior surface of the jacket to surround the outer ring zone;

a plurality of first wires arranged in the outer ring zone, each of said first wires being of a coaxial wire including an inner conductor concentrically enclosed within a metallic layer;

a plurality of second wires arranged in the inner center zone, said second wires including a twisted-pair wires for transmission of USB2.0 signal, at least one detective wire, and two power return wires of which one is an exposed inner conductor and the other is an unexposed inner conductor protectively enclosed within an insulative layer; and a connector including a metal shell enclosing a printed circuit board; wherein the unexposed inner conductor is mechanically and electrically connected to the printed circuit board while the exposed inner conductor is electrically connected to the braiding layer.

18. The USB Type-C cable assembly as claimed in claim 17, wherein said exposed inner conductor is electrically connected to the metal shell of the connector.

19. The USB Type-C cable assembly as claimed in claim 17, wherein said second wires further include two subsidiary wires to cooperate with the detective wire to form a triangular configuration, viewed along axial direction of the jacket, and each of said power return wires is located between the detective wire and the corresponding subsidiary wire, said two power return wires having different outer diameters so as to provide an asymmetrical arrangement with the triangular configuration.

20. The USB Type-C cable assembly as claimed in claim 17, wherein said metallic layer of each of said first wires is mechanically and electrically connected to the braiding layer.

* * * * *